US012734431B2

(12) United States Patent
Shushkov

(10) Patent No.: US 12,734,431 B2
(45) Date of Patent: Sep. 15, 2026

(54) TRAINING GROUND FOR TRAINING TEAMS

(71) Applicant: Ilia Olegovich Shushkov, Helsinki (FI)

(72) Inventor: Ilia Olegovich Shushkov, Helsinki (FI)

( * ) Notice: Subject to any disclaimer, the term of this patent is extended or adjusted under 35 U.S.C. 154(b) by 204 days.

(21) Appl. No.: 18/837,600

(22) PCT Filed: Jan. 18, 2023

(86) PCT No.: PCT/IB2023/050412
§ 371 (c)(1),
(2) Date: Aug. 11, 2024

(87) PCT Pub. No.: WO2023/152574
PCT Pub. Date: Aug. 17, 2023

(65) Prior Publication Data

US 2025/0177844 A1 Jun. 5, 2025

(30) Foreign Application Priority Data

Feb. 11, 2022 (RU) ..... RU2022103499

(51) Int. Cl.
*E04H 3/10* (2006.01)
*A63B 24/00* (2006.01)
*A63C 19/02* (2006.01)

(52) U.S. Cl.
CPC ..... *A63C 19/02* (2013.01); *A63B 24/00* (2013.01); *A63B 24/0062* (2013.01); *E04H 3/10* (2013.01)

(58) Field of Classification Search
CPC ..... A63B 69/00; A63B 24/00; A63B 34/0062; E04H 3/00; E04H 3/10; E04H 3/14
See application file for complete search history.

(56) References Cited

U.S. PATENT DOCUMENTS 3,697,068 A * 10/1972 McDougall ..... A63B 69/0053 273/DIG. 7
2003/0144090 A1* 7/2003 Belik ..... A63B 71/022 473/473

FOREIGN PATENT DOCUMENTS

RU 2428238 * 6/2011 ..... A63B 67/12

* cited by examiner

*Primary Examiner* — Nathan J Flynn

(57) ABSTRACT

Disclosed is a training ground for training user teams, the training ground comprising 5 two main sections having a common side; and two additional sections each sharing a common side with one of the main sections, the common side being provided with a passage for moving between the main section and the additional sections, wherein each of the additional sections is provided with an entrance for moving between the additional sections, and the entrance is spaced from the passage, and each main section is provided with a tag designed to 0 be touched by a user or a signal device/button device designed to be activated by a user in order to complete the training session.

12 Claims, 1 Drawing Sheet

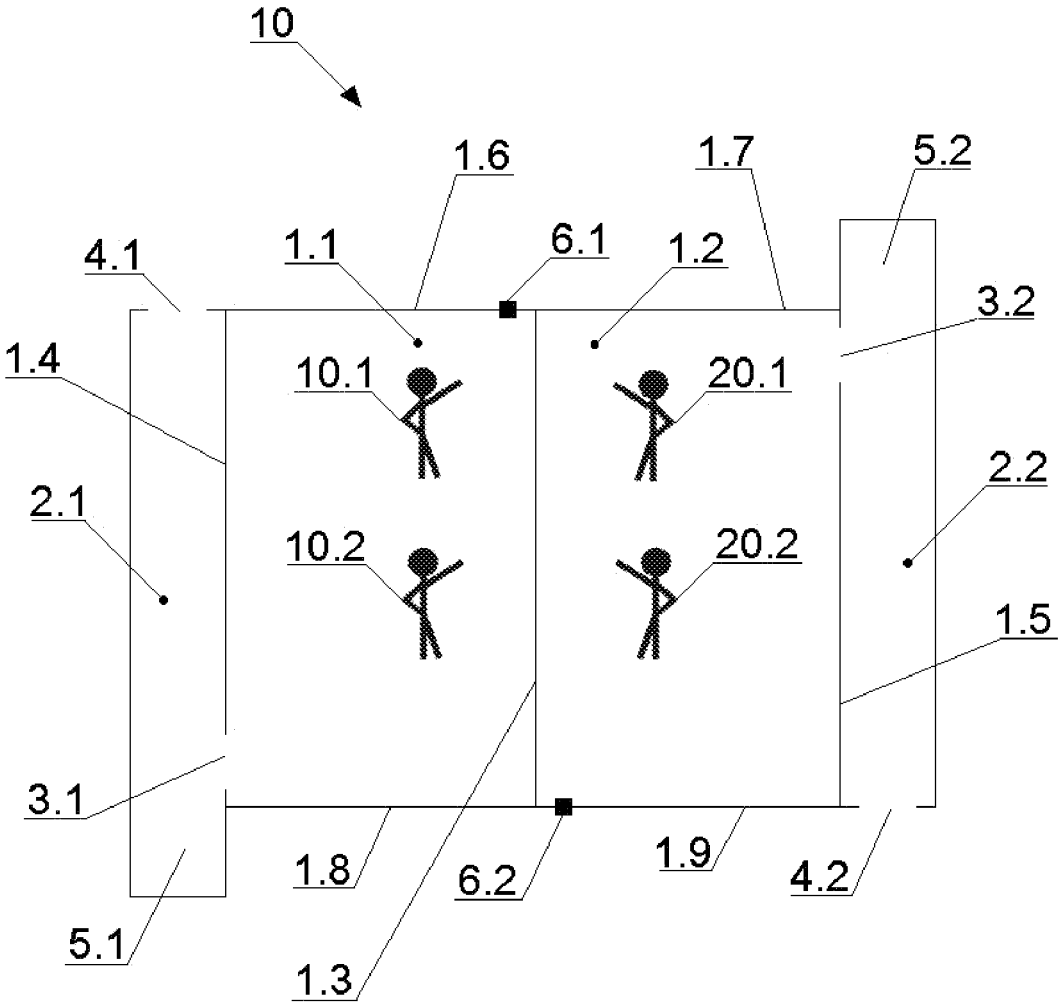
10
1.6
1.7
5.2
4.1
1.1
6.1
1.2
3.2
1.4
10.1
20.1
2.2
2.1
10.2
20.2
1.5
3.1
1.8
6.2
1.9
4.2
5.1
1.3

TRAINING GROUND FOR TRAINING TEAMS

FIELD OF THE INVENTION

The present invention relates to sports, in particular to means for training users, namely to a training ground for training user teams.

BACKGROUND OF THE INVENTION

Most modern sports grounds or training grounds simulate training processes where two or more opponents may oppose each other or training processes where trained users related to two or more opposing teams oppose each other. Such training processes predominantly focus on a physical aspect of the training session aimed at improving physical skills of the opposing users related to the opposing teams participating in the training process by using such training grounds.

An illustrative example of a training ground for training user teams is disclosed in Russian patent No. 2428238 (hereinafter referred to as RU 2428238) filed on Sep. 10, 2010. In particular, RU 2428238 discloses a training ground for training user teams, the training ground comprising: two main sections having a common side; and two additional sections each sharing a common side with one of the main sections.

One of disadvantages of the prior art training ground for training user teams as disclosed in RU 2428238 is in that the training ground of RU 2428238 lowly or insufficiently improves logical and physical skills of users related the trained teams when they interact with each other.

Therefore, training grounds for training user teams are required to be obviously improved, in particular in order to develop an improved combination of logical and physical skills for users related to the trained teams interacting with each other by using such training grounds, thereby accelerating the physical and mental development of each trained user.

Consequently, a technical problem to be solved by the present invention is to develop a training ground which would at least partly eliminate the above disadvantage of the prior art training ground, i.e. eliminate the problem of the slow physical and mental development of each trained user.

SUMMARY OF THE INVENTION

An objective of the present invention is to develop a training ground solving at least the above-mentioned technical problem.

To achieve the objective of the invention, in a first aspect of the present invention there is provided a training ground for training user teams, the training ground comprising: two main sections having a common side; two additional sections each sharing a common side with one of the main sections, the common side being provided with a passage for moving between the main section and the additional sections, wherein each of the additional sections is provided with an entrance for moving between the additional sections, and the entrance is spaced from the passage, and wherein the main and additional sections are formed by a protruding element or protruding elements attached to a surface of the training ground, and wherein each main section is provided with a tag spaced from a corresponding passage and designed to be touched by a user related to a trained opposing team in order to complete the training session.

To achieve the objective of the invention, in a first aspect of the present invention there is provided a training ground for training user teams, the training ground comprising: two main sections having a common side; two additional sections each sharing a common side with one of the main sections, the common side being provided with a passage for moving between the main section and the additional sections, wherein each of the additional sections is provided with an entrance for moving between the additional sections, and the entrance is spaced from the passage, and the main and additional sections are formed by a protruding element or protruding elements attached to a surface of the training ground, and wherein each main section is provided with a signal device or a button device spaced from a corresponding passage and designed to be activated by a user related to a trained opposing team in order to complete the training session.

A technical effect provided by the training ground for training user teams according to any one of the above aspects of the present invention is an increased training efficiency of users related to the trained teams using the training ground, in particular due to the fact that each trained user improves themselves not only physically, but also intellectually during the process of training by using the training ground, in particular each trained user improves user's attention span, coordination, decision-making speed, binocular vision, tactical skills, etc. In other words, the structural features of the training ground according to the present invention allow each user involved in the training process by using the training ground to improve user's logical skills and physical skills simultaneously, both individually and in combination, by applying user's physical skills depending on a specific situation at the training ground. In particular, a user related to any trained team, the user aiming to touch the tag of the other trained team in order to complete the training session, is required to leave the main section and additional section related to the user's trained team and then enter the additional section and main section related to the other trained team, in particular by using available entrances and passages of the training ground, wherein the user has to continuously monitor the locations and actions of other users related to the user's trained team, and the locations and actions of users related to the other trained team within the sections of the training ground and to continuously make decisions as to whether to physically interact with the users related to the other trained team and/or to continue the movement between the sections of the training ground in order to reach the target tag faster than any one of the users related to the other team.

In another embodiment of the present invention, each additional section of the training ground may have dimensions suitable for accommodating only one user of any one of the trained teams across the width of the additional section. Providing each additional section of the training ground with dimensions suitable for accommodating only one user related to any one of the trained teams across the width of the additional section further contributes to the above technical effect which is increased efficiency of training users related to the trained teams, in particular due to the fact that such dimensions of the additional section further complicate the possibility of passing the additional section by each user aiming to touch the tag of the other trained team, since the user has to additionally take this factor into account when making the decision to move through the entrance to the additional section of the other trained team, and/or when making the decision to move directly over the additional section towards the passage with which the additional section is interconnected with the main section of the other trained team where the target tag is located. In other words, each user aiming to touch the tag of the other trained team needs to further simultaneously (i) consider the possibility of only one user among the users of their own trained team, including the user themselves, being able to be located or move across the width of the additional section of the other trained team after entering the additional section through the entrance, (ii) consider the possibility of physical interaction with at least one user from the other trained team if they are located in the additional section, and (iii) consider the possibility of similar behavior of at least one user from the other trained team while observing (e.g., during direct observation or through peripheral vision) the location and behavior of the users related to the other trained team.

In yet another embodiment of the present invention, each of the entrances and passages of the training ground can have dimensions suitable to be passed therethrough by only one user of any one of the trained teams at a time. Providing each of the entrances and passages of the training ground with dimensions suitable to be passed therethrough by only one user of any one of the trained teams at a time further contributes to the above technical effect which is increased efficiency of training users related to the trained teams, in particular due to the fact that such dimensions of the entrances and passages of the training ground further complicate the decision-making process to be performed by each user aiming to touch the tag of the other trained team since the user has to additionally take these factors into account when making the decision to move through the entrance to the additional section related to the other trained team and when making the decision to move through the passage from the additional section to the main section related to the other trained team where the target tag is arranged. In other words, each user aiming to touch the tag of the other trained team needs to further simultaneously (i) consider the possibility of only one user among the users of their own trained team, including the user themselves, being able to pass through the entrance to the additional section of the other trained team at a time, (ii) consider the possibility of only one user among the users of their own trained team, including the user themselves, being able to pass through the passage from the additional section of the other trained team to the main section of the other trained team, where the target tag is located, at a time, (iii) consider the possibility of physical interaction with at least one user from the other trained team if they are located in the entrance, (iv) consider the possibility of physical interaction with at least one user from the other trained team if they are located in the passage, and (v) consider the possibility of similar behavior of at least one user from the other trained team while observing (e.g., during direct observation or through peripheral vision) the location and behavior of the users related to the other trained team.

In some embodiments of the present invention, each additional section of the training ground may comprise a non-contact zone designed to accommodate a user related to one of the trained teams and to prevent the physical interaction of the accommodated user with users related to the other trained team. The non-contact zone in each additional section of the training ground, the non-contact zone being designed to accommodate a user related to one of the trained teams and to prevent the physical interaction of the accommodated user with users related to the other trained team, further contributes to the above technical effect which is increased efficiency of training users related to the trained teams, in particular due to the fact that the non-contact zone in each additional section of the training ground complicates the decision-making process to be performed by each user aiming to touch the tag of the other trained team since the user has to additionally take this factor into account when making the decision to move from the additional section to the main section where the target tag is arranged. In other words, each user aiming to touch the tag of the other trained team, when located in the additional section related to the other trained team, needs to further simultaneously (i) consider the possibility of the user moving to the non-contact zone of the additional section with the possibility of retaining their location in the additional section, and (ii) consider the possibility of similar behavior of at least one user from the other trained team while observing (e.g., during direct observation or through peripheral vision) the location and behavior of the users related to the other trained team.

In other embodiments of the present invention, each non-contact zone of the training ground may be adjacent to a corresponding passage between an interconnected main section and additional section. Implementing each non-contact zone of the training ground in such a way that it is adjacent to the corresponding passage between the interconnected main section and additional section further contributes to the above technical effect of increasing the efficiency of training users related to the trained teams, in particular due to the fact that such arrangement of non-contact zones of the training ground further complicates the decision-making process to be performed by each user aiming to touch the tag of the other trained team, since the user has to additionally take this factor into account when making the decision to move from the additional section to the main section where the tag is located. In other words, each user aiming to touch the tag of the other trained team, when located in the additional section of the other trained team, needs to further simultaneously (i) consider the possibility of the user moving to the non-contact zone of the additional section with the possibility of retaining their location in the additional section close to the passage between the additional section and target main section to which the non-contact zone is adjacent, and with the possibility of quickly moving from the non-contact zone to the main section containing the target tag of the other trained team, and (ii) consider the possibility of similar behavior of at least one user from the other trained team while observing (e.g., during direct observation or through peripheral vision) the location and behavior of the users related to the other trained team.

In other embodiments of the present invention, each non-contact zone of the training ground may be arranged outside the main section. Arranging each non-contact zone of the training ground outside the main section further contributes to the above technical effect which is increased efficiency of training users related to the trained teams, in particular due to the fact that such arrangement of the non-contact zone essentially lengthens the additional section that has to be passed by each user aiming to touch the tag of the other trained team in order to complete the training session, which, in turn, not only increases the distance from the entrance to the passage that the user has to travel to move from the additional section to the main section where the tag is located, but also increases the possibility of at least one user from the other trained team that the user has to get past in order to move from the additional section to the main section being present in the additional section due to the fact that the user from the other trained team would have more time to counteract the user in the additional section. In turn, lengthening the path of each user aiming to touch the tag over the additional section of the training ground belonging to the other trained team, and increasing the probability of a user from the other trained team being present in the additional section further complicate the decision-making process of the user, since they have to additionally take these factors into account when making the decision to move from the additional section to the main section where the tag is located. In other words, each user aiming to touch the tag of the other trained team, when passing through the entrance to the additional section of the other trained team, needs to further simultaneously (i) consider the distance from the entrance to the passage that the user has to travel over the additional section in order to reach the main section containing the target tag, and therefore, the potential duration of their movement over the additional section to reach the main section containing the target tag via the passage, (ii) consider the possibility of at least one user from the other trained team appearing in the additional section on the movement path of the user over the additional section, and (iii) consider the possibility of similar behavior of at least one user from the other trained team while observing (e.g., during direct observation or through peripheral vision) the location and behavior of the users related to the other trained team.

BRIEF DESCRIPTION OF THE DRAWINGS

The accompanying drawing provided to allow for a better understanding of the present invention, forms part of, and is incorporated herein to illustrate the following embodiments and aspects of the present invention. The accompanying FIGURE, in conjunction with the following description, serves to explain the principles of the present invention.

The FIGURE illustrates the main design features of an embodiment of a training device for training user teams according to the present invention.

DETAILED DESCRIPTION OF THE INVENTION

Some examples of possible embodiments of the present invention are described below, with the following description not intended to define or limit the scope of the present invention.

The FIGURE shows a training device 10 for training user teams according to the present invention, the device formed by a sports or training field or a sports or training ground, the implementation features thereof allowing to refine or improve the process of training trainees or users related to two different or opposing user teams, i.e. users related to two opposing teams to be trained.

The training ground 10 shown in the FIGURE comprises two identical main sections 1.1, 1.2, each having a rectangular shape and having a common elongated side 1.3, wherein the elongated side 1.3 has a length preferably corresponding to a size of three users with average body dimensions lined up, wherein each such user can belong to any one of the two opposing trained teams. In other words, the main sections 1.1, 1.2 included in the training ground 10 are substantially adjacent to each other and separated from each other by a longitudinal line corresponding to the common side 1.3 thereof. It should be noted that the opposite shortened sides of each of the main sections 1.1, 1.2 each have a length preferably corresponding to the size of two users with average body dimensions lined up, wherein each such user can belong to any of the two opposing trained teams.

The training ground 10 shown in the FIGURE further comprises two identical additional sections 2.1, 2.2 each having a rectangular shape, wherein the additional section 2.1 has a common elongated side 1.4 with the main section 1.1, and the additional section 2.2 has a common elongated side 1.5 with the main section 1.2. In other words, the additional section 2.1 included in the training ground 10 is substantially adjacent to the main section 1.1 and separated therefrom by a longitudinal line corresponding to the common side 1.4 thereof, and the additional section 2.2 included in the training ground 10 is substantially adjacent to the main section 1.2 and separated therefrom by a longitudinal line corresponding to the common side 1.5 thereof. It should be noted that the additional sections 2.1, 2.2 each have dimensions suitable for accommodating only one user from any one of the trained teams across the width of the additional section.

Thus, as shown in the FIGURE, the width of the main section 1.1 is bounded by the sides 1.3, 1.4 substantially forming opposite elongated sides of the main section 1.1, and the length of the main section 1.1 is bounded by the sides 1.6, 1.8 substantially forming opposite shortened sides of the main section 1.1, while the width of the main section 1.2 is bounded by the sides 1.3, 1.5 substantially forming opposite elongated sides of the main section 1.2, and the length of the main section 1.2 is bounded by the sides 1.7, 1.9 substantially forming opposite shortened sides of the main section 1.2, wherein the main section 1.1 and the main section 1.2 are bilaterally symmetrical with respect to the common side 1.3 serving as the axis of symmetry.

In addition, in the common side 1.4 separating the main section 1.1 from the additional section 2.1, a passage 3.1 is formed between the main section 1.1 and the additional section 2.1, so that the main section 1.1 and the additional section 2.1 are interconnected with each other by means of the passage 3.1, allowing users related to the trained teams to move or transition between the main section 1.1 and the additional section 2.1 using the passage 3.1. Similarly, in the common side 1.5 separating the main section 1.2 from the additional section 2.2, a passage 3.2 is formed between the main section 1.2 and the additional section 2.2, so that the main section 1.2 and the additional section 2.2 are interconnected with each other by means of the passage 3.2, allowing users related to the trained teams to move or transition between the main section 1.2 and the additional section 2.2 using the passage 3.2. It should be noted that the passages 3.1, 3.2 are formed on the opposite ends or end portions of the elongated sides 1.4, 1.5, adjacent respectively to the shortened side 1.8 and the shortened side 1.7 arranged or located along the length of the training ground 10 at a predetermined distance from each other corresponding to the length of the common side 1.3, so that a user from a trained team passing through the passage 3.1 and a user from a trained team passing through the passage 3.2 substantially arrive respectively in the portion of the main section 1.1 and the portion of the main section 1.2 adjacent to the shortened side 1.8 of the main section 1.1 and the shortened side 1.7 of the main section 1.2, which are spaced from each other at a distance corresponding to the length of the common side 1.3.

It should be noted that each pair of interconnected sections of the training ground 10 are sized to allow for interaction between users related to different trained teams, allowing them to displace each other beyond one of said sections, with each displaced user being eliminated from the training process or session. Thus, users related to one of the two opposing trained teams, corresponding to one pair of interconnected sections of the training ground 10 formed of interconnected main section 1.1 and additional section 2.1, and users related to the other team of the two opposing trained teams, corresponding to the other pair of interconnected sections of the training ground 10 formed of interconnected main section 1.2 and additional section 2.2, can physically interact with each other when located in any section relating to any one of said two pairs of interconnected sections of the training ground 10, and attempt to displace each other beyond said section (e.g., by pulling or pushing, grabbing each other by different body parts and/or articles of clothing) in order to eliminate each such user displaced beyond the section from the training session and thereby reduce the number of participating users related to the trained team to which said user displaced beyond the section belonged. It should also be noted that users belonging to the same trained team of the two opposing trained teams can be freely located in any section relating to any one of the two pairs of interconnected sections of the training ground 10, i.e. without the requirement for physical interaction with each other in order to displace each other beyond the section.

In addition, in the shortened side of the additional section 2.1 spaced from the passage 3.1, a entrance 4.1 is formed between the additional section 2.1 and the common area or common space outside the training ground 10, wherein users related to different trained teams can freely move without needing or being able to physically interact with each other, so that the additional section 2.1 is interconnected with the common space surrounding the training ground 10 by means of the entrance 4.1, allowing any user from any trained team to move or pass between the additional section 2.1 and said common space using the entrance 4.1, e.g., to enter from said common space into the additional section 2.1 through the entrance 4.1 or exit from the additional section 2.1 into said common space through the entrance 4.1. Similarly, in the shortened side of the additional section 2.2 spaced from the passage 3.2, a entrance 4.2 is formed between the additional section 2.2 and the common area or common space outside the training ground 10, wherein users related to different trained teams can freely move without needing to physically interact with each other, so that the additional section 2.2 is interconnected with the common space surrounding the training ground 10 by means of the entrance 4.2, allowing any user from any trained team to move or pass between the additional section 2.2 and said common space using the entrance 4.2, e.g., to enter from said common space into the additional section 2.2 through the entrance 4.2 or exit from the additional section 2.2 into said common space through the entrance 4.2. It should be noted that the entrance 4.1 and the entrance 4.2 are substantially formed on opposite sides of the training ground 10. It should also be noted that the shortened side of the additional section 2.1 wherein the entrance 4.1 is formed, and the shortened side of the additional section 2.2 wherein the entrance 4.2 is formed, substantially form an extension of the shortened side 1.6 and the shortened side 1.9, respectively, arranged on opposite sides of the training ground 10.

Thus, the entrance 4.1 and the entrance 4.2 respectively provided in the shortened side of the additional section 2.1 and the shortened side of the additional section 2.2 and spaced from the passage 3.1 and the passage 3.2, respectively, allow for movement of the users related to the trained teams between the additional sections 2.1, 2.2 through the common space surrounding the training ground 10. In other words, at least one of the users related to one of the trained teams, belonging to the main and additional sections 1.1, 2.1, can leave the additional section 2.1 through the entrance 4.1 and move through the common space surrounding the training ground 10 to the entrance 4.2, through which said user can enter the additional section 2.2. Similarly, at least one of the users related to the other trained team, belonging to the main and additional sections 1.2, 2.2, can leave the additional section 2.2 through the entrance 4.2, and move through the common space surrounding the training ground 10 to the entrance 4.1, through which said user can enter the additional section 2.1, wherein users related to different trained teams, in case of encountering each other in the common space outside the training ground 10, do not interact with each other physically in any way, i.e. do not in any way prevent each other from moving in said common space.

As shown in the FIGURE, the additional section 2.1 comprises a non-contact zone 5.1 configured to accommodate a user from one of the trained teams which belongs to the main and additional sections 1.1, 2.1, without the possibility of physical interaction with users related to the other trained team which belongs to the main and additional sections 1.2, 2.2, wherein the non-contact zone 5.1 is located in close proximity to the passage 3.1 between the interconnected main and additional sections 1.1, 2.1 or adjacent to said passage 3.1, so that the additional section 2.1 in a portion of the non-contact zone 5.1 thereof is located or arranged substantially outside the main section, and the shortened side of the additional section 2.1 opposite to the other shortened side of the additional section 2.1 provided with the entrance 4.1 is located at a set distance from the shortened side 1.8. Similarly, the additional section 2.2 comprises a non-contact zone 5.2 configured to accommodate a user from one of the trained teams which belongs to the main and additional sections 1.2, 2.2, without the possibility of physical interaction with users related to the other trained team which belongs to the main and additional sections 1.1, 2.1, wherein the non-contact zone 5.2 is located in close proximity to the passage 3.2 between the interconnected main and additional sections 1.2, 2.2 or adjacent to said passage 3.2, so that the additional section 2.2 in a portion of the non-contact zone 5.2 thereof is located or arranged substantially outside the main section, and the shortened side of the additional section 2.2 opposite to the other shortened side of the additional section 2.2 provided with the entrance 4.2 is located at a set distance from the shortened side 1.7. It should be noted that the non-contact zone 5.1 and the non-contact zone 5.2 each have dimensions suitable for accommodating only one user from one of the trained teams without obstruction, i.e. without the possibility of physical interaction of said user with users related to the other trained team and without the possibility of physical interaction of users related to the other trained team with said user. Thus, if the user from one of the trained teams belonging to the main and additional sections 1.1, 2.1 is present in the non-contact zone 5.2, none of the users related to the other trained team belonging to the main and additional sections 1.2, 2.2 can physically interact with said user, and said user cannot physically interact with any of the users related to said other trained team. Similarly, if the user from the trained team belonging to the main and additional sections 1.2, 2.2 is present in the non-contact zone 5.1, none of the users related to the opposing trained team belonging to the main and additional sections 1.1, 2.1 can physically interact with said user, and said user cannot physically interact with any of the users related to said opposing trained team.

In addition, it should be noted that a user from one trained team, when present in a non-contact zone belonging to a territory or area for the users related to the opposing team, can take a set position or a set posture (e.g., take a squatting position) indicating to the users related to said opposing team that said user is present in said non-contact zone and that no physical action can be taken against him by said users related to the opposing team, wherein when said user leaves or moves beyond the non-contact zone previously occupied by them, any of said users related to the opposing team can physically interact with said user at any time within the main section or the additional section corresponding to said non-contact zone in an attempt to displace each other beyond said section wherein said physical interaction occurs, that is, in an attempt to pull or push each other beyond any of the sides limiting or defining said section wherein said physical interaction occurs.

In addition, the entrances 4.1, 4.2 and the passages 3.1, 3.2 have dimensions (in particular, a width corresponding to a portion of the length of the side of the section in which the particular entrance or passage is formed) suitable to be passed therethrough by only one user of any one of the trained teams at a time. In other words, the dimensions of any of the entrances 4.1, 4.2 and passages 3.1, 3.2 do not allow two users related to the same trained team to pass therethrough simultaneously, but only sequentially or one after another, while users related to different trained teams trying to pass through the same entrance or passage would also not be able to do so simultaneously and will have to enter into physical interaction with each other in said location in an effort to displace each other beyond the corresponding one of the sections of the training ground 10 or in an effort to pass through said location.

In one embodiment of the present invention, the training ground 10 can be manufactured as a final product which can be manufactured in a specialized workshop or industrial facility and subsequently delivered to the place of use or installation. In this embodiment, the body, base, or main portion of the training ground 10 can be formed, e.g., by a solid plate or a solid piece of any suitable material or any combination of suitable materials (in particular, such solid piece can be formed as a single-layer piece or a multi-layer piece) which can be shaped and sized to generally conform to the perimeter or contour of the above-described training ground 10, wherein the sides of the training ground 10 described above and substantially forming the main sections 1.1, 2.1, and the additional sections 2.1, 2.2 can be formed, e.g., by bulges, walls, or other suitable prominent or protruding elements which can be attached or secured to the body or main portion of the training ground 10 using, e.g., glue, nails, screws, self-tapping screws or other fasteners known in the art and suitable for attaching said protruding elements to the main portion of the training ground 10, with the height thereof not interfering with the physical interaction of users related to different trained teams while allowing the users to pull or push each other beyond any of said protruding elements of the training ground 10. Furthermore, as an alternative in this embodiment of the present invention, the sides of the training ground 10 described above and substantially forming the main sections 1.1, 2.1 and the additional sections 2.1, 2.2 can be formed by lines applied to the body or the main portion of the training ground 10 using paint, enamel, cold plastic, thermoplastic (molten plastic), a special dye or staining agent, special polymer bands, and other suitable means known in the art which can be used to apply said lines to the surface of the main portion of the training ground 10 opposite to the support surface of the main portion of the training ground 10 whereby said main portion of the training ground 10 is mounted or placed on the surface of the ground, the surface of any suitable terrain feature, or the surface of any suitable physical object at the site of use of such training ground 10 (e.g., on asphalt, a playground, etc.). Furthermore, as an alternative in this embodiment of the present invention, the sides of the training ground 10 described above and substantially forming the main sections 1.1, 2.1 and the additional sections 2.1, 2.2 can be formed by a continuous or sectioned tape of any suitable material, including a rubberized tape, an adhesive tape, a fabric tape, a polypropylene belt tape, or a cord, a rope or any other suitable band of material which can be arranged or composed of separate pieces of material on the surface of the main portion of the training ground 10 to form the main sections 1.1, 2.1 and the additional sections 2.1, 2.2 having the above-described features, wherein similar means of flexible tape material (flexible tape of any suitable material known in the art), means of rolling-up material, and means made of interwoven, twisted or plied fibers can be attached to the main portion of the training ground 10 using glue, nails, studs, screws, self-tapping screws or other suitable fasteners known in the art.

In another embodiment of the present invention, the training ground 10 can be provided as a prefabricated article, the body or main portion of which can be assembled from prefabricated sections or parts at the place of manufacture thereof, e.g. in a special workshop or industrial facility, followed by delivery of such prefabricated article to the place of use or installation, or can be assembled from prefabricated sections or parts at the place of use or installation of said prefabricated article. In this embodiment, the body, base, or main portion of the training ground 10 can be formed, e.g., by several separate plates or pieces of any suitable material or any combination of suitable materials (in particular, such separate pieces can each be formed as a single-layer piece or a multi-layer piece) which be connected or fastened together using any suitable fasteners, wherein the resulting main portion would take on the shape and size generally conforming to the perimeter or contour of the above-described training ground 10, and the sides of the training ground 10 described above and substantially forming the main sections 1.1, 2.1, and the additional sections 2.1, 2.2 can be formed, e.g., by bulges, walls, or other suitable prominent or protruding elements which can be attached or secured to the body or main portion of the training ground 10 using, e.g., glue, nails, screws, self-tapping screws or other prior art fasteners suitable for attaching said protruding elements to the main portion of the training ground 10, with the height thereof not interfering with the physical interaction of users related to different trained teams while allowing the users to pull or push each other beyond any of said protruding elements of the training ground 10. Furthermore, as an alternative in this embodiment of the present invention, the sides of the training ground 10 described above and substantially forming the main sections 1.1, 2.1 and the additional sections 2.1, 2.2 can be formed by lines applied to the body or the main portion of the training ground 10 using paint, enamel, cold plastic, thermoplastic (molten plastic), a special dye or staining agent, special polymer bands, and other suitable means known in the art which can be used to apply said lines to the surface of the main portion of the training ground 10 opposite to the support surface of the main portion of the training ground 10 whereby said main portion of the training ground 10 is mounted or placed on the surface of the ground, the surface of any suitable terrain feature, or the surface of any suitable physical object at the site of use of such training ground 10 (e.g., on asphalt, a playground, etc.). Furthermore, as an alternative in this embodiment of the present invention, the sides of the training ground 10 described above and substantially forming the main sections 1.1, 2.1 and the additional sections 2.1, 2.2 can be formed by a continuous or sectioned tape of any suitable material, including a rubberized tape, an adhesive tape, a fabric tape, a polypropylene belt tape, or a cord, a rope or any other suitable band of material which can be arranged or composed of separate pieces of material on the surface of the main portion of the training ground 10 to form the main sections 1.1, 2.1 and the additional sections 2.1, 2.2 having the above-described features, wherein similar means of flexible tape material (flexible tape of any suitable material known in the art), means of rolling-up material, and means made of interwoven, twisted or plied fibers can be attached to the main portion of the training ground 10 using glue, nails, studs, screws, self-tapping screws or other suitable fasteners known in the art.

In yet another embodiment, the training ground 10 can be formed by a continuous or sectioned flexible tape of any suitable material known in the art, e.g., a rubberized tape, an adhesive tape, a fabric tape, a polypropylene belt tape, or any other flexible band of material arranged or placed on the surface of the ground, the surface of any suitable terrain feature, or the surface of any suitable physical object at the site of installation or use of the training ground 10 (e.g., on asphalt, a playground, etc.) to form main sections 1.1, 2.1, and additional sections 2.1, 2.2 having the above-described features, wherein such flexible band of material can be attached to said surface at the site of installation or use of the training ground 10 using any suitable fasteners known in the art, including using metal or plastic pegs which can be inserted into openings in the form of eyelets made in the body of said flexible band of material, to secure said band of material to soft, loose or free-flowing surfaces at the site of installation or use of the training ground 10.

In some embodiments, the training ground 10 can be formed by a continuous or sectioned flexible tape of any suitable material known in the art, such as an elongate means of any suitable rolling-up material known in the art, or a means of interwoven, twisted or plied fibers of any suitable material known in the art, such as a cord, rope, wire, thread, or the like, arranged or placed on the surface of the ground, the surface of any suitable terrain feature, or the surface of any suitable physical object at the site of installation or use of the training ground 10 (e.g., on asphalt, a playground, etc.) to form main sections 1.1, 2.1, and additional sections 2.1, 2.2 having the above-described features, wherein such elongated means of a rolling-up material or fiber material can be attached to said surface at the site of installation or use of the training ground 10 using any suitable fasteners known in the art.

In other embodiments, the training ground 10 can be formed a portion of the surface of the ground, a portion of the surface of any suitable terrain feature, or a portion of the surface of any suitable physical object at the site of installation or use of the training ground 10 (e.g., a portion of asphalt, a portion of a playground, or the like) bounded by a combination of lines or by lines applied to said portion using paint, enamel, cold plastic, thermoplastic (molten plastic), a special dye or staining agent, special polymer bands, and other suitable means known in the art that can be used to apply said lines to said portion, thus forming main sections 1.1, 2.1, and additional sections 2.1, 2.2 having the above-described features.

Moreover, as shown in the FIGURE, the main section 1.1 is provided with a tag 6.1 formed on the shortened side 1.6 and spaced from the passage 3.1, wherein the tag 6.1 essentially corresponds to one of the trained teams belonging to the main and additional sections 1.1, 2.1, wherein the users related to said team seek to prevent the possibility of said tag being touched by any of the users related to the opposing team belonging to the main and additional sections 1.2, 2.2, and is configured to be touched by a user from said trained opposing team in order to complete the training session or the training process. Similarly, the main section 1.2 is provided with a tag 6.2 formed on the shortened side 1.9 and spaced from the passage 3.2, wherein the tag 6.2 essentially corresponds to one of the trained teams belonging to the main and additional sections 1.2, 2.2, wherein the users related to said team seek to prevent the possibility of said tag being touched by any of the users related to the opposing team belonging to the main and additional sections 1.1, 2.1, and is configured to be touched by a user from said trained opposing team in order to complete the training session or the training process.

In one embodiment of the present invention, the tag 6.1 and the tag 6.2 can each be formed by any distinguishing mark or element (e.g., a pattern, print, sticker, patch, member, etc.) corresponding to a trained team relating respectively to the tag 6.1 or the tag 6.2 and aiming to protect it from users related to the other trained team, wherein such distinguishing element can be (1) applied to the corresponding shortened side of the main section of the training ground 10 using paint, enamel, cold plastic, thermoplastic (molten plastic), a special dye or staining agent, or other suitable means known in the art which can be used to apply the distinguishing element to the surface of said shortened side; or (2) sewn, glued or attached using any suitable means; or (3) integrally formed with said shortened side of the training ground 10 during manufacturing or production of the training ground 10 or during manufacturing or production of said shortened side. In an embodiment of the present invention wherein the tag 6.1 and the tag 6.2 are each formed by any distinguishing mark or element, the notification for the act of touching a tag (in particular, the tag 6.1 by any user from the trained team belonging to the main and additional sections 1.1, 2.1, or the tag 6.2 by any user from the trained team belonging to the main and additional sections 1.2, 2.2), and therefore for the completion of the training session or the training process, can be carried out in the following ways: (i) a user from one of the trained teams touching the tag corresponding to the other trained team personally notifies all other users related to both trained teams about said user touching the tag and thus completing the training session or training process using their voice or other audible signal (e.g., using a personal sound-generating device or appliance, such as a whistle, horn, signaling device, siren, or the like), wherein the users related to both trained teams personally monitor and validate the fact of touching said tag, or an outside user observing the training session or training process and not belonging to any of the trained teams monitors and validates the fact of touching said tag; or (ii) an outside user observing the training session or training process and not belonging to any of the trained teams notifies users related to both trained teams about a user touching a tag and thus completing the training session or training process using their voice or other audible signal (e.g., using a personal sound-generating device or appliance, such as a whistle, horn, signaling device, siren, or the like).

In another embodiment of the present invention, the tag 6.1 and the tag 6.2 can each be formed by a radio frequency tag (RFID tag) or a QR code corresponding to a particular user trained team relating to the tag 6.1 or the tag 6.2, respectively, and aiming to protect the tag from users related to the other trained team, said tag configured to be readable by a dedicated reader or reader device belonging to a user from said other trained team. It should be noted that the tag formed by an RFID tag can be glued or otherwise attached using any suitable fastener known in the art to the corresponding shortened side of the main section of the training ground 10, so that any user from the trained opposing team which does not relate to said RFID tag can read it using their own personal reader or reader device configured to read and recognize such RFID tag. It should also be noted that a tag formed by a QR code can be applied to the corresponding shortened side of the main section of the training ground 10 using paint, enamel, cold plastic, thermoplastic (molten plastic), a special dye (e.g., ink, gel, etc.), or other suitable means known in the art, so that any user from the trained opposing team which does not relate to said QR code can read it using their own personal reader or reader device configured to read and recognize such QR code. In this embodiment, each user from any one of the trained teams should essentially have their own personal reader or reader device (which can be, e.g., a portable handheld device, a rod with one end thereof provided with a reader for reading and processing the RFID tag or the QR code, a wrist device formed by a watch or bracelet equipped with means for reading and processing the RFID tag or the QR code) which should be preconfigured to read and recognize the RFID tag or the QR code corresponding to the trained opposing team. Furthermore, in this embodiment, each personal reader can be further provided with a signal device or can include a signaling unit for issuing alarm signals in the form of sound or voice signals, notifying or alerting users related to the trained teams about a particular tag having been read and, therefore, about the completion of the training session or the training process. As an alternative to the use of a signal device, each personal reader can comprise a remote signal device which be placed or secured on one of the sides of any main section or any additional section or generally outside the training ground 10, wherein said remote signal device can receive a signal transmitted from the personal reader over a preset wireless communication channel established between the signal device and the personal reader after reading and processing the corresponding RFID tag or QR code by this personal reader, with the signal instructing the signal device to issue or generate a sound alert notifying or alerting the users of the trained teams about the completion of the training session or the training process.

In yet another embodiment of the present invention, first and second signal devices 6.1, 6.2 can be used instead of the tags, each device corresponding to a specific user trained team relating respectively to the first signal device 6.1 or the second signal device 6.2 and aiming to protect said signal device from users related to the other trained team, wherein said signal device can be activated or actuated by a user from said other trained team, e.g., by pressing a push button which said signaling device can be equipped with, by touching a touch screen which said signaling device can be equipped with, or using any other suitable method apparent to those skilled in the art. It should be noted that in this embodiment of the present invention, each of the first and second signal devices 6.1, 6.2 can be glued or otherwise attached using any suitable fasteners known in the art to the corresponding shortened side of the main section of the training ground 10 (in particular at locations corresponding to the tags shown in the FIGURE), so that any user from the trained opposing team which does not relate to said signal device can activate it or actuate it in the manner described above, which would cause said signal device to generate an audible alert signal to notify or alert the users of the trained teams about the completion of the training session or the training process.

In other embodiments of the present invention, first and second button devices 6.1, 6.2 can be used instead of the tags, each of device corresponding to a specific user trained team relating respectively to the first button device 6.1 or the second button device 6.2 and aiming to protect said button from users related to the other trained team, wherein said button device can be pressed, actuated or otherwise activated by a user from said other trained team. It should be noted that in this embodiment of the present invention, each of the first button device 6.1 and the second button device 6.2 can be glued or otherwise attached using any suitable fasteners known in the art to the corresponding shortened side of the main section of the training ground 10 (in particular at locations corresponding to the tags shown in the FIGURE), so that any user from the trained opposing team which does not relate to said button can press or otherwise activate the corresponding button device, which would cause said button device to output a control signal to a remote signal device via a wireless communication channel which can be established between said button device and said signal device upon activation of said button device or via a wired communication channel pre-established between said button device and said signal device. In this embodiment of the present invention, the above remote signal device can be placed or secured on one of the sides of any main section or any additional section or generally installed outside the training ground 10, wherein said remote signal device can receive a signal transmitted from the activated button device over the established communication channel and instructing the signal device to issue or generate a sound alert notifying or alerting the users of the trained teams about the completion of the training session or the training process.

The training session or the training process using the training ground 10 begins with users 10.1, 10.2 belonging to the same trained team located in their initial positions at any location within the main section 1.1, and with users 20.1, 20.2 belonging to the opposed or other trained team located in their initial positions at any location within the main section 1.2, with the basic task of users 10.1, 10.2 being to reach the tag 6.2, and the basic task of users 20.1, 20.2 being to reach the tag 6.1 in order to complete the training session or the training process. In order to reach the tag 6.2, any one of the users 10.1, 10.2 should carry out at least the following actions using the training ground 10: (i) move from their main section 1.1 to their additional section 2.1 using the passage 3.1 by means of which the main and additional sections 1.1, 2.1 are interconnected with each other; (ii) after that, exit their additional section 2.1 into the common space surrounding the training ground 10 using the entrance 4.1 by means of which the additional section 2.1 and the said common space are interconnected with each other; (iii) after that, enter or move into the additional section 2.2 belonging to the trained opposing team from said common space using the entrance 4.2 by means of which the additional section 2.2 and said common space are interconnected with each other; and (iv) ultimately enter or move into the main section 1.2 belonging to the trained opposing team from said additional section 2.2 using the passage 3.2 by means of which the additional section 2.2 and the main section 1.2 are interconnected with each other, wherein, when located within the additional section 2.2, said user can remain in the non-contact zone 5.2 wherein they cannot physically interact with any one of the users 20.1, 20.2. Similarly, in order to reach the tag 6.1, any one of the users 20.1, 20.2 should carry out at least the following actions using the training ground 10: (i) move from their main section 1.2 to their additional section 2.2 using the passage 3.2 by means of which the main and additional sections 1.2, 2.2 are interconnected with each other; (ii) after that, exit their additional section 2.2 into the common space surrounding the training ground 10 using the entrance 4.2 by means of which the additional section 2.2 and the said common space are interconnected with each other; (iii) after that, enter or move into the additional section 2.1 belonging to the trained opposing team from said common space using the entrance 4.1 by means of which the additional section 2.1 and said common space are interconnected with each other; and (iv) ultimately enter or move into the main section 1.1 belonging to the trained opposing team from said additional section 2.1 using the passage 3.1 by means of which the additional section 2.1 and the main section 1.1 are interconnected with each other, wherein, when located within the additional section 2.1, said user can remain in the non-contact zone 5.1 wherein they cannot physically interact with any one of the users 10.1, 10.2.

It should be noted that the manner in which a user from any one of the trained teams performs the above basic task is determined by themselves depending on the following factors: assessment of their physical fitness, assessment of the physical fitness of the remaining users related to their trained team, assessment of the physical fitness of the users related to the trained opposing team, assessment of their own location on the training ground 10, assessment of the locations of the remaining users related to their trained team on the training ground 10, in particular within the sections of the training ground 10, and assessment of the locations of the users related to the trained opposing team on the training ground 10, in particular within the sections of the training ground 10.

For example, when the user 10.1 from the trained team corresponding to the main and additional sections 1.1, 2.1 is in their initial or base position within their main section 1.1 of the training ground 10, they may decide to take a position within the main section 1.1 or additional section 1.2 to prevent or disallow any user from the opposing team from reaching their tag 6.1, decide to stay within the main section 1.1 and pull at least one of the users 20.1, 20.2 across the common side 1.3, or decide to reach the entrance 4.2 to the additional section 2.2 belonging to the trained opposing team corresponding to the main and additional sections 1.2, 2.2 before the users 20.1, 20.2 from said trained opposing team can exit said additional section 2.2, in order for the user 10.1 to subsequently reach the tag 6.2. In this case, the user 10.1, as he moves towards the entrance 4.2, should monitor whether they have made a mistake in estimating their movement speed and the movement speed of the users 20.1, 20.2 from the trained opposing team over the corresponding sections of the training ground 10. If the user 10.1 made a mistake in estimating their movement speed and/or the movement speed of the users 20.1, 20.2 from the trained opposing team over the corresponding sections of the training ground 10, which may potentially lead to users 20.1, 20.2 exiting their additional section 2.2 through the entrance 4.2 earlier, then the user 10.1 has to again make a tactical decision, in particular whether the remaining user 10.2 (and more generally, the remaining users related to their trained team, when each trained team is comprised of three or more users) from their trained team will be able to physically resist or counteract said users 20.1, 20.2 from the trained opposing team who have already exited their additional section 2.2 through the entrance 4.2.

If the user 10.1 decides that the remaining user 10.2 from their trained team will be able to resist or counteract the users 20.1, 20.2 from the trained opposing team, thus preventing at least one of said users 20.1, 20.2 from reaching the tag 6.1, then the user 10.1 can continue their movement in order to reach the tag 6.2.

Having reached the entrance 4.2 to the additional section 2.2, the user 10.1 has to again make a tactical decision, in particular whether they will immediately attempt to pass through the additional section 2.2 with subsequent entry into the main section 1.2 through the passage 3.2, limit themselves to passing over the additional section 2.2 and subsequently stopping in the non-contact zone 5.2, or remain in the additional section 2.2 outside the non-contact zone 5.2 thereof with the possibility of monitoring said additional section 2.2 (i.e. providing the possibility of physical interaction with a user or users related to the trained opposing team who may seek to leave their additional section 2.2). Factors that will generally influence the user 10.1 to make one of one of the above decisions at the time they reach the entrance 4.2 to the additional section 2.2 will be the correlation between the skills of the user 10.1 and those of the user or users related to the trained opposing team who stayed in order to protect their tag 6.2, as well as the development of the situation regarding the protection of the tag 6.1 by the remaining users related to the trained team to which the user 10.1 belongs.

In the event that the user 10.1 decides to take a position to monitor the additional section 2.2, they can take a position within the additional section 2.2 which would be optimal for pulling or pushing users related to the trained opposing team who might attempt to exit the additional section 2.2, wherein the user 10.1 has to independently determine at what distance from the passage 4.2, the entrance 3.2 and/or the non-contact zone 5.2 they should be located in the additional section 2.2.

In the event that the user 10.1 decides that they can reach the tag 6.2 to complete the training session or the training process by overcoming the physical resistance of the users related to the trained opposing team, or notices the protection of their tag 6.1 by the remaining users related to the trained team to which the user 10.1 belongs weakening, they can make a break through the users related to the trained opposing team using deceptive maneuvers and/or forceful interaction as the user moves towards the tag 6.2 over the additional section 2.2 and the main section 1.2, while the moment of initiating such a break has to be determined by the user 10.1 independently. In addition, the user 10.1 can make a similar break from the non-contact zone 5.2, if they had previously decided to stay in said non-contact zone 5.2, while the moment of initiating such a break has to be determined by the user 10.1 independently. All the above decisions are taken by the user 10.1 dynamically during specific episodes over fractions of a second by evaluating the locations of the users related to their trained team and the locations of the users related to the trained opposing team within the sections of the training ground 10 and by taking into account the correlation of user forces at each moment of the training session.

During execution of any selected training tactic, a secondary task to be solved by a user from any one trained team is displacing, in particular pushing or pulling, the user or users related to the trained opposing team beyond the sides or boundaries of the sections of the training ground 10 in order to eliminate each such displaced user from the training session, which essentially weakens said trained opposing team. In particular, the user 10.1 has to constantly monitor the balance of power between the rest of the users related to their trained team to which the user 10.1 belongs and the users related to the trained opposing team in the area of their tag 6.1 and/or their non-contact zone 5.1, as that is the reference point for tactical decisions being made by the user 10.1.

In addition, during execution of tactical actions, the user 10.1 has to also monitor the locations and actions of users related to the trained opposing team located in close proximity to said user and potentially able to push or pull the user 10.1 beyond the boundaries of the sides of the section wherein said user is located at the moment of making the tactical decision. In addition, both when making the above break into the main section 1.2 to reach the tag 6.2, and when physically interacting or contacting one or more users related to the trained opposing team, the user 10.1 has to continuously compare their skills and abilities with those of each of said users related to the trained opposing team before or during the maneuver or element of training of pushing or pulling each user from the trained opposing team or making a break towards the tag 6.2, and at any time has to be ready to stop carrying out such element of training if they decide that they are unable to perform it.

It should be noted that it should be apparent to those skilled in the art that the above embodiments of the present invention can be combined with each other in any suitable manner to produce a particular combined embodiment of the present invention, wherein parts of the above description relating to the embodiments being combined essentially form the description of the combined embodiment or disclose implementation features of the combined embodiment.

The above exemplary embodiments of the present invention, examples and description serve only to provide a better understanding of the claimed invention and are not limiting. It should be apparent to those skilled in the art that other embodiments of the present invention are possible and will be understood by those skilled in the art in view of the foregoing description of the present invention, in particular, various modifications or alterations of the above-described design or structural features of the training device 10 of the present invention, as well as various modifications, variations or equivalent substitutions of the above-described structural parts, elements or components included in the training device 10 or used for manufacturing or assembly thereof, without departing from the scope of the present invention. The scope of the present invention is defined by the appended claims only.

The invention claimed is:

1. A training ground for training user teams, comprising:
two main sections having a common side, and
two additional sections each sharing a common side with one of the main sections, the common side being provided with a passage for moving between the main section and the additional sections, wherein each of additional sections is provided with an entrance for moving between the additional sections, and the entrance is spaced from the passage, wherein
said main and additional sections are formed by a protruding element or protruding elements attached to a surface of the training ground, and
each main section is provided with a tag spaced from a corresponding passage, wherein the tag is designed to be touched by a user related to a trained opposing team in order to complete the training session.

2. The training ground according to claim 1, wherein the additional sections have identical widths being smaller than that of any of the main sections.

3. The training ground according to claim 1, wherein the entrances and passages have identical widths defined by a width of any of the additional sections.

4. The training ground according to claim 1, wherein each additional section comprises a non-contact zone configured to accommodate a user related to one of the trained teams and to prevent the physical interaction of the accommodated user with users related to the other trained team.

5. The training ground according to claim 4, wherein each non-contact zone is adjacent to a corresponding passage between the interconnected main section and additional section.

6. The training ground according to claim 5, wherein the non-contact zone is located outside the main section.

7. A training ground for training user teams, comprising:
two main sections having a common side, and
two additional sections each sharing a common side with one of the main sections, the common side being provided with a passage for moving between the main section and the additional sections, wherein each of the additional sections is provided with an entrance for moving between the additional sections, and the entrance is spaced from the passage, wherein
the main and additional sections are formed by a protruding element or protruding elements attached to a surface of the training ground, and
each main section is provided with a signal device or a button device spaced from a corresponding passage and designed to be activated by a user related to a trained opposing team in order to complete the training session.

8. The training ground according to claim 7, wherein the additional sections have identical widths being smaller than that of any of the main sections.

9. The training ground according to claim 7, wherein the entrances and passages have identical widths defined by a width of any of the additional sections.

10. The training ground according to claim 7, wherein each additional section comprises a non-contact zone configured to accommodate a user related to one of the trained teams and to prevent the physical interaction of the accommodated user with users related to the other trained team.

11. The training ground according to claim 10, wherein each non-contact zone is adjacent to a corresponding passage between the interconnected main section and additional section.

12. The training ground according to claim 11, wherein the non-contact zone is located outside the main section.

* * * * *